United States Patent [19]

Staniszewski

[11] Patent Number: 4,729,683

[45] Date of Patent: Mar. 8, 1988

[54] PAPER SHEET FEEDING APPARATUS

[75] Inventor: Tadeusz Staniszewski, Budd Lake, N.J.

[73] Assignee: Ziyad Incorporated, Denville, N.J.

[21] Appl. No.: 822,064

[22] Filed: Jan. 24, 1986

[51] Int. Cl.[4] ..... B41J 11/58

[52] U.S. Cl. ..... 400/624; 400/569; 400/625; 400/629; 400/630; 400/636.2; 271/9

[58] Field of Search ..... 400/630, 569, 611, 624, 400/625, 629, 636.2; 271/9, 116

[56] References Cited

U.S. PATENT DOCUMENTS

| | | | |
|---|---|---|---|
| 1,182,052 | 5/1916 | Stocking | 400/625 |
| 3,430,748 | 3/1969 | Parri | 400/625 |
| 3,857,471 | 12/1974 | Hoffman et al. | 400/611 X |
| 4,089,402 | 5/1978 | Hyland et al. | 400/625 |
| 4,090,410 | 5/1978 | Nakamura | 400/569 X |
| 4,248,415 | 2/1981 | Steinhilber | 271/9 |
| 4,326,815 | 2/1982 | Kapp | 400/625 |
| 4,564,187 | 1/1986 | Costa et al. | 400/636.2 X |
| 4,570,919 | 2/1986 | Huang | 400/624 X |
| 4,620,809 | 11/1986 | Runzi | 400/629 X |

*Primary Examiner*—Ernest T. Wright, Jr.
*Attorney, Agent, or Firm*—Lerner, David, Littenberg, Krumholz & Mentlik

[57] ABSTRACT

A paper sheet feeding apparatus is constructed of paper feed rollers arranged in association with a respective paper tray and adapted to be driven by rotation of a printer platen in a forward paper feeding direction, with selection of the appropriate paper tray from which paper is to be fed, by a combination of forward and reverse rotations of the printer platen. The paper feed rollers, associated with each of the paper trays, are mounted on shafts which extend transversely of the apparatus. A plurality of driven gear assemblies are respectively arranged in operative association with the paper feed rolls and are adapted for lateral sliding movement between engaged and disengaged positions relative to a selector gear whose rotation is synchronized with that of the printer platen. In the disengaged position, no drive coupling is provided between the printer platen and the paper feed rollers, whereas in the engaged position, the associated paper feed rollers are coupled to the printer platen via its associated driven gear assembly and the selector gear. The selector gear is mounted on the apparatus and is adapted to be selectively coupled to the printer platen via means of a spring loaded drive arm selectively engagable with a drive pulley which together transfer rotation from the printer platen. In addition to sheets of paper, the paper sheet feeding apparatus accommodates envelopes to be fed from a supply thereof.

21 Claims, 9 Drawing Figures

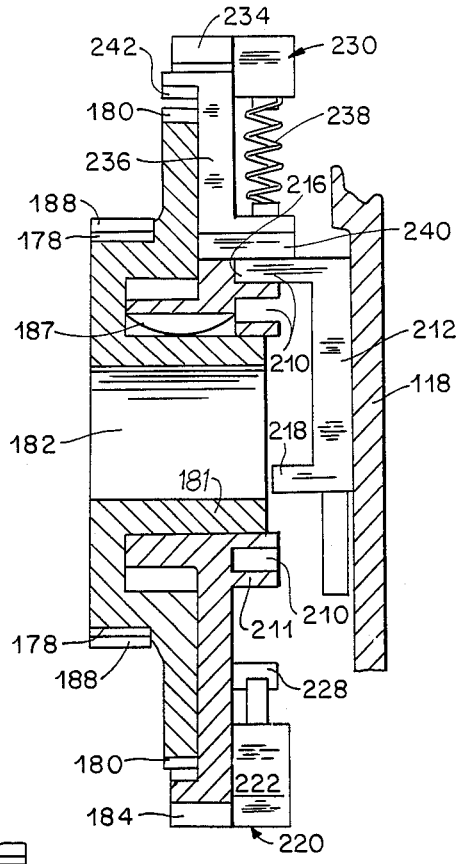
FIG. 3
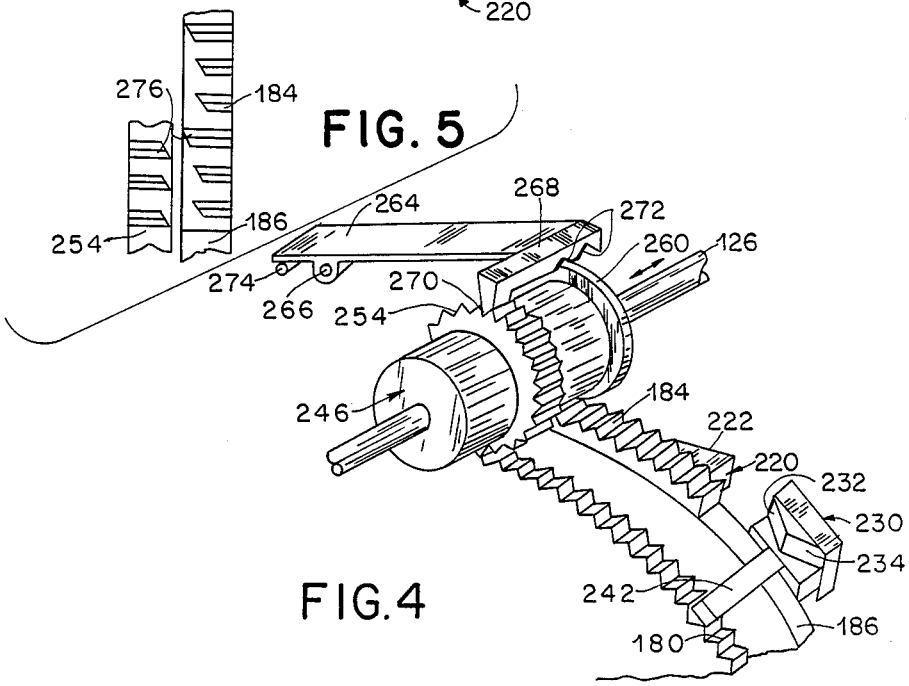
FIG. 5
FIG. 4

PAPER SHEET FEEDING APPARATUS

BACKGROUND OF THE INVENTION

The present invention relates in general to a mechanical, demand-type, paper sheet feeder for feeding pre-cut sheets of paper or envelopes from different paper trays a rotating printer platen. More specifically, the paper sheet feeder includes various feed rollers associated with the different paper trays, and which are adapted to be forwardly driven for paper sheet feeding by rotation of the printer platen in a forward paper introduction direction, with selection of the appropriate paper tray from which sheets of paper or envelopes are to be fed being made by a combination of forward and reverse rotations of the printer platen. In this regard, once the appropriate paper tray has been selected by the appropriate combination of reverse and forward rotations of the printer platen, the corresponding feed rollers are rotated only by forward rotation of the printer platen for introducing sheets of paper or envelopes into the printer.

Tremendous advances have been made in the last few years in automating office procedures. Conventional typewriters have grown into mini-computers for performing word processing, storage and other functions. The speed at which these machines produce words on paper is increasing at a rapid rate. As added speed and sophistication are developed into such machines, the actual putting of words onto paper becomes ancillary to the main function of collecting and organizing the information into a format to be printed. In order to have flexibility and speed, many systems have been developed where an operator manipulates words on a cathode ray tube or other word processing equipment until the final copy is in the format desired. With all of these advantages, it has developed that today one of the major bottlenecks in terms of time, and therefore usefulness of this equipment, is the rate at which paper can be brought to and move past a printing head to produce the final hard copy.

Of course, it is possible to use continuous sheets of perforated paper, as is commonly done in computer applications, having sprocket holes along the sides thereof to continuously feed and move the paper through an impact printer. This, however, requires special paper which is not suitable to the many requirements for which normal typewriting is employed.

Many machines exist, both copying machines and printing machines, which automatically feed paper past a printing or reproducing station. These machines are normally run synchronously such that prior to the time the paper is fed, the information to be printed on the paper is already organized and the papers move past the printing head in a continuous fashion. This is not generally suitable for impact printing devices, since impact printing is accomplished with the paper stationary rather than moving, and further the adaption of normal typewriting type printing requires moving of paper not only in an intermittent basis, but also in the forward and reverse direction in accordance with the information to be typed. Still further, with such existing equipment, it is generally not possible to manually feed separate sheets of paper, which may be of different size or thickness such as, for example, envelopes, without disconnecting the equipment from the printing machine.

In U.S. Pat. No. 4,326,815, which patent is assigned to the same assignee of the present invention, there is disclosed a paper sheet feeding apparatus, including a removable paper tray, which is capable of being retrofitted with respect to existing printing devices, i.e., distributed as an after market product, as well as being capable of being sold and distributed with the printing device. The retrofit characteristic of this paper sheet feeding apparatus lends itself to conform to the climate of the existing impact printing devices, rather than requiring the radical modification thereof, so as to conform with the needs of high speed paper feeding. Another known paper feeding apparatus adapted to be retrofitted onto an existing printing device is known from U.S. Pat. No. 4,248,415. Although the former known paper sheet feeding apparatus has been commercially successful, the selection of a paper tray is software dependent upon a stored program routine. This necessitates the use of a microprocessor and suitable hardware responsive to the specially designed program. On the other hand, although the latter known paper sheet feeding apparatus is of the mechanical type, such apparatus requires the use of a mechanical assembly which may prove unreliable over extended use.

SUMMARY OF THE INVENTION

In accordance with the present invention, the paper sheet feeding apparatus is constructed of various feed rollers arranged in association with a respective paper tray and adapted to be driven by rotation of a printer platen in a forward paper introducing direction, with selection of the appropriate paper tray from which paper is to be fed, by a combination of forward and reverse rotations of a printer platen. The paper feed rolls, associated with each of the paper trays, are mounted on shafts which extend transversely of the apparatus. On the outside of one of the side frames of the apparatus, there are provided drive gears which are adapted for a lateral sliding movement between engaged and disengaged positions relative to a selector gear which is synchronized with the printer platen. In the disengaged position, no drive coupling is provided between the printer platen and the feed rollers, whereas in the engaged position, the associated feed roller is coupled to the printer platen via its associated drive gear and the selector gear. The selector gear is mounted on the side frame of the apparatus and is adapted to be selectively coupled to the printer platen via means of a spring loaded drive arm selectively engagable with a drive pulley which together transfer rotation from the printer platen.

More specifically, when the selector gear is in its so-called neutral or home position, the drive arm is disengaged from the drive pulley, such that forward rotation of the printer platen does not cause the selector gear to rotate. Upon reverse rotation of the printer platen, however, the drive arm engages the drive pulley and couples the drive pulley to the selector gear. As the selector gear is continued to be driven by reverse rotation of the printer platen, a selector arm having a camming flange, located on the selector gear, engages the driven gear on the first feed roller shaft, causing the driven gear to move laterally inward into engagement with the selector gear. Reversing of rotation of the printer platen after movement of the driven into engagement with the selector gear, i.e., so that the printer platen rotates in a paper introducing or forward direction, causes the selector gear to drive the driven gear of the feed roller shaft in a paper feeding direction to feed a sheet of paper from the selected tray. On the other hand, continued reverse rotation of the printer platen after camming of the selected driven gear inwardly, will bring a ramp-like surface on the selector gear into engagement with the selected driven gear to cause the driven gear to be laterally shifted out of engagement with the selector gear. In this manner, the next peripherally most driven gear can be respectively cammed inwardly into engagement with the selector gear upon continued reverse rotation of the printer platen, and be coupled for transmission of driving force from the printer platen, depending upon the reversal of the direction of the printer platen rotation.

An internal camming arrangement is provided in association with the selector gear to insure a proper amount of coupling interconnection between the printer platen and the associated driven gear to insure that the paper being fed is introduced into and in engagement with the printer platen. After a sheet of paper has been fed into the printer and is in engagement with the printer platen, the printer platen is again reversed for a short number of increments to move the leading edge of the sheet of paper to the entrance into the printer platen. During this reverse rotation of the printer platen, the feed rollers are not engaged and, accordingly, the sheet tends to buckle along the internal paper feed path. This buckling action is utilized to insure proper alignment of the paper to the printer platen. That is, backing out of the leading edge of the sheet of paper to the entrance of the printer platen assures alignment of the paper therewith. Thereafter, the printer platen is rotated in a forward paper introducing direction, a predetermined number of increments to move the sheet of paper to the first print line. It will therefore be appreciated that, in accordance with the apparatus of the present invention, the printer platen is reversed a predetermined number of increments and then moved forwardly to cause engagement of the appropriate or selected laterally slidable driven gear with the selector gear. However, driving rotation of the driven gear is only accomplished with forward printer platen motion.

In accordance with one embodiment of the present invention, there is disclosed a paper feeding apparatus for a printing device, the printing device including printing means for printing on a sheet of paper, and paper advancing means for advancing a sheet of paper being supplied thereto along a paper path upon rotation of the paper advancing means in a paper advancing direction, the paper feeding apparatus comprising paper storing means for storing a plurality of individual sheets of paper, paper feeding means for feeding individual sheets of paper from the paper storing means upon rotation of the paper feeding means in a paper feeding direction, and transmission means for coupling the paper advancing means to the paper feeding means, the transmission means adapted to rotate the paper feeding means in the paper feeding direction to feed a sheet of paper from the paper storing means along the paper path towards the printing means in response to the rotation of the paper advancing means in the paper advancing direction, and to align the leading edge of the sheet of paper adjacent the paper advancing means upon rotation of the paper advancing means in a direction opposite to the paper advancing direction while interrupting the operation of the paper feeding means.

In accordance with another embodiment of the present invention, there is disclosed a paper feeding apparatus for a printing device, the printing device including printing means for printing on a sheet of paper, and paper advancing means for advancing a sheet of paper being supplied thereto along a paper path upon rotation of the paper advancing means in a paper advancing direction, the paper feeding apparatus comprising first paper storing means for storing a plurality of individual sheets of paper, first paper feeding means for feeding individual sheets of paper from the first paper storing means upon rotation of the first paper feeding means in a paper feeding direction, first driven gear means operable between an engaged position with the first paper feeding means to cause the rotation thereof in the paper feeding direction and a disengaged position with the first paper feeding means to interrupt the operation thereof, second paper storing means for storing a plurality of individual sheets of paper, second paper feeding means for feeding individual sheets of paper from the second paper storing means upon rotation of the second paper feeding means in a paper feeding direction, second driven gear means operable between an engaged position with the second paper feeding means to cause the rotation thereof in the paper feeding direction and a disengaged position with the second paper feeding means to interrupt the operation thereof, and transmission means for selectively coupling the first and second driven gear means to the first and second paper feeding means in response to the rotation of the paper advancing means, the transmission means adapted to selectively arrange the first and second driven gear means in the engaged position upon rotation of the paper advancing means in an opposite direction to the paper advancing direction and selectively arranging the first and second driven gear means in the disengaged position upon continued rotation of the paper advancing means in the opposite direction, whereby individual sheets of paper are alternately fed from the first and second paper storing means upon selective engagement of a corresponding the first and second driven gear means and upon the rotation of the paper advancing means in the paper advancing direction.

In accordance with another embodiment of the presenet invention, there is disclosed a printing device comprising printing means for printing on a sheet of paper, paper storing means for storing a plurality of individual sheets of paper, paper feeding means for feeding individual sheets of paper from the paper storing means upon rotation of the paper feeding means in a paper feeding direction, paper advancing means for advancing a sheet of paper fed from the paper storing means along a paper path upon rotation of the paper advancing means in a paper advancing direction, and transmission means for coupling the paper advancing means to the paper feeding means, the transmission means adapted to rotate the paper feeding means in the paper feeding direction to feed a sheet of paper from the paper storing means along the paper path towards the printing means in response to the rotation of the paper advancing means in the paper advancing direction, and to align the leading edge of the sheet of paper adjacent the paper advancing means upon rotation of the paper advancing means in a direction opposite to the paper advancing direction while interrupting the operation of the paper feeding means.

In accordance with another embodiment of the present invention, there is disclosed a printing device comprising printing means for printing on a sheet of paper, first paper storing means for storing a plurality of individual sheets of paper, first paper feeding means for feeding individual sheets of paper from the first paper storing means upon rotation of the first paper feeding means in a paper feeding direction, first driven gear means operable between an engaged position with the first paper feeding means to cause the rotation thereof in the paper feeding direction and a disengaged position with the first paper feeding means to interrupt the operation thereof, second paper storing means for storing a plurality of individual sheets of paper, second paper feeding means for feeding individual sheets of paper from the second paper storing means upon rotation of the second paper feeding means in a paper feeding direction, second driven gear means operable between an engaged position with the second paper feeding means to cause the rotation thereof in the paper feeding direction and a disengaged position with the second paper feeding means to interrupt the operation thereof, paper advancing means for advancing a sheet of paper fed from the first and second paper storing means along a paper path upon rotation of the paper advancing means in a paper advancing direction, and transmission means for selectively coupling the first and second driven gear means to the first and second paper feeding means in response to the rotation of the paper advancing means, the transmission means adapted to selectively arrange the first and second driven gear means in the engaged position upon rotation of the paper advancing means in an opposite direction to the paper advancing direction and selectively arranging the first and second driven gear means in the disengaged position upon continued rotation of the paper advancing means in the opposite direction, whereby individual sheets of paper are alternately fed from the first and second paper storing means upon selective engagement of a corresponding the first and second driven gear means and upon the rotation of the paper advancing means in the paper advancing direction.

In accordance with another embodiment of the present invention, there is disclosed a method for feeding individual sheets of paper to a printing device, the printing device including printing means for printing on a sheet of paper, paper advancing means for advancing a sheet of paper being supplied thereto along a paper path upon rotation of the paper advancing means in a paper advancing direction, and paper storing means for storing a plurality of individual sheets of paper, the method comprising the steps of feeding individual sheets of paper from the paper storing along said paper path means upon rotation of the paper feeding means in a paper feeding direction, coupling the paper advancing means to the paper feeding means by rotating the paper advancing means in a direction opposite to the paper advancing direction, rotating the paper advancing means in the paper advancing direction to rotate the paper feeding means in the paper feeding direction to feed a sheet of paper from the paper storing means along the paper path towards the printing means, and aligning the leading edge of the sheet of paper adjacent the paper advancing means by rotating the paper advancing means in a direction opposite to the paper advancing direction while interrupting the operation of the paper feeding means.

In accordance with another embodiment of the present invention, there is disclosed a method for feeding individual sheets of paper to a printing device, the printing device including printing means for printing on a sheet of paper, paper advancing means for advancing a sheet of paper being supplied thereto along a paper path upon rotation of the paper advancing means in a paper advancing direction, first and second paper storing means for storing a plurality of individual sheets of paper, first and second paper feeding means for feeding individual sheets of paper from a corresponding one of the first and second paper storing means, and first and second driven gear means operable between an engaged position with a corresponding one of the first and second paper feeding means to cause the rotation thereof in a paper feeding direction and a disengaged position to interrupt the operation thereof, the method comprising the steps of arranging one of the first and second driven gear means in the engaged position by rotating the paper advancing means in an opposite direction to the paper advancing direction, arranging the other of the first and second driven gear means in the disengaged position by rotation of the paper advancing means in the opposite direction, and feeding individual sheets of paper from one of the first and second paper storing means by rotating the corresponding engaged driven gear means in a paper feeding direction in response to the rotation of the paper advancing means in the paper advancing direction.

BRIEF DESCRIPTION OF THE DRAWINGS

The above description, as well as further objects, features and advantages of the present invention will be more fully understood by reference to the following detailed description of a presently preferred, but nonetheless illustrative, paper sheet feeding apparatus in accordance with the present invention when taken in conjunction with the accompanying drawings wherein:

FIG. 3 is a cross-sectional view of the transmission showing a drive arm operative for selectively coupling the drive gear to the selector gear, and a selector arm having a camming flange for engaging the driven gears;

FIG. 4 is a perspective view showing a driven gear in a laterally disengaged position from the selector gear and the drive arm having ramp-like surfaces for engaging the flange of the driven gear;

FIG. 5 is a partial top plan view of the selector gear and drive gear as shown in FIG. 4.

DETAILED DESCRIPTION

Figure 1:
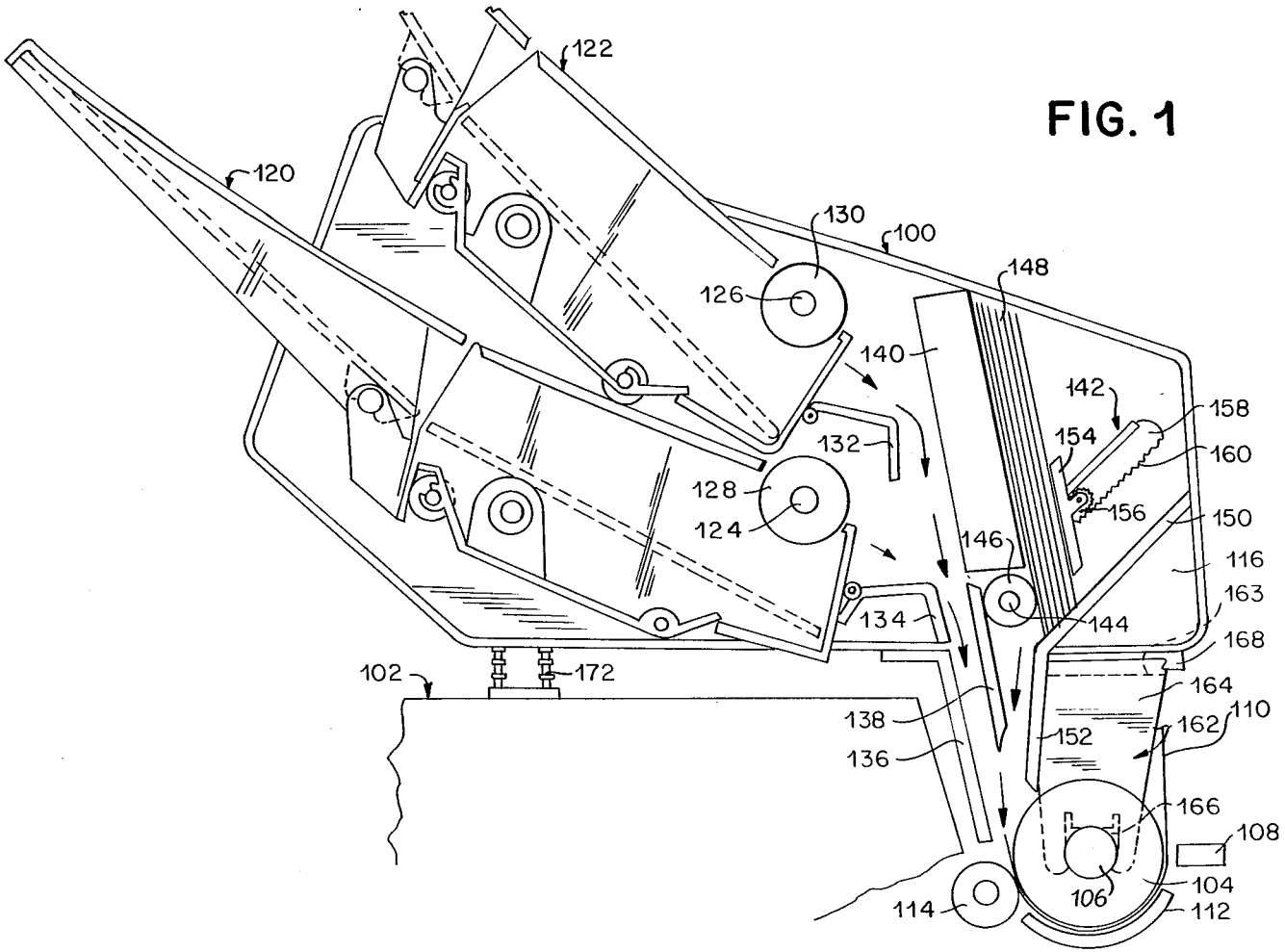
FIG. 1 is a side elevational view having one side removed for showing the paper feed paths provided between a forward envelope tray and a pair of adjustable paper trays, and the rotating platen of the printer.

Referring now to the drawings wherein like reference numerals represent like elements, there is shown in FIG. 1 a paper sheet feeding apparatus 100 mounted onto a printing device 102 for operation in conjunction therewith. The printing device 102 generally includes a rotatable, transversely extending printer platen 104 which is adapted to rotate about a transversely extending shaft 106, and a movable print head 108 which is adapted to traverse, back and forth, across the traverse length of the platen. As is conventional, a sheet of paper 110, to be printed on by the print head 108, is received between the platen 104, a curved paper guide 112 and a pressure roller 114 in engagement with the platen for advancing a sheet of paper to the print head. The print head 108 is carried by a movable carriage which traverses across the transverse extent of the platen 104 by means of a suitable carriage motor. The print head 108 is arranged to be closely spaced from the platen 104 so that printing, in lines, is achieved on the sheet of paper 110 as the print head traverses between the ends of the platen. During the printing operation, the platen 104 serves to rotate intermittently about its shaft 106 to advance the sheet of paper 110 longitudinally relative to the print head 108 for the printing of the next line thereon by virtue of the transverse movement of the print head with respect thereto. This printing operation may be as in a conventional typewriter, from left to right, or the printing may be from left to right on one line of print, with the next line of print being effected by movement of the print head 108 from right to left. This latter means of printing is commonly used in many present day word processing systems.

The paper sheet feeding apparatus 100, in accordance with the present invention, is mainly designed for use with printing devices 102 automatic printing or typing capabilities, i.e., printing systems or devices in which a complete page of print is effected automatically without or with a minimal amount of instructions from the user. In such systems, the test of the matter to be printed may have been previously stored on a disk or other similar recording device, or may be in the memory of a cathode ray tube on which a user has completed work to arrange the matter or information in a desired format. When desired, the system simply prints the desired information onto sheets of paper 110.

Generally, in the printing operation, the matter or information is printed one line at a time, with the sheet of paper 110 then being automatically advanced for effecting printing of the next line, and so on until an entire page is printed. Such printing devices 102 are generally of the impact printing type, i.e., the print head 108 impacts the sheet of paper 110 against the platen 104 to effect the printing. However, it should be appreciated that the paper sheet feeding apparatus 100 could also be used with other types of printing devices such as, for example, ink jet printers, line printers, and/or non-impact electrostatic printers.

As will be appreciated from the description hereinbelow, the paper sheet feeding apparatus 100, in accordance with the present invention, is particularly well adapted to be retrofitted with such printing devices 102. As shown in FIG. 1, the paper sheet feeding apparatus 100 includes a pair of spaced-apart side frames 116, 118 (see FIG. 2), housing an adjustable lower paper tray 120 and an overlying adjustable upper paper tray 122. Overlying in operative association with the paper trays 120, 122, there is provided respective transversely extending rotatable paper shafts 124, 126 each supporting pairs of spaced-apart paper feed rollers 128, 130, only one of each pair being shown. The paper feed rollers 128, 130 are secured to the paper shafts 124, 126 for common rotation therewith and made adjustable as to be described hereinafter. In the alternative, the paper shafts 124, 126 may be of non-circular cross-section to permit common rotation of the paper feed rollers 128, 130 while allowing the paper feed rollers to be moved transversely along the paper shafts to achieve precision alignment with the upper and lower paper trays 120, 122. Sheets of paper 110, fed from the lower and upper paper trays 120, 122, are advanced to the platen 104 along the respective paper paths indicated by the arrows. The paper paths for the lower and upper paper trays 120, 122 are defined by a plurality of cooperating paper guides 132, 134, 136, 138, 140.

Forward within the paper sheet feeding apparatus 100 and overlying the platen 104, there is provided an envelope feed assembly generally designated by reference numeral 142. The envelope feed assembly includes a transversely extending rotatable envelope paper shaft 144 supporting a single envelope feed roller 146 having a rubber portion molded onto the envelope paper shaft. A stack of envelopes 148 are supported along one front major surface by the paper guide 140, and along their lower edge by an inclined paper guide 150. The envelope path, as indicated by the arrows, between the envelope feed roller 146 and the platen 104 is defined by the paper guide 138 and an opposed adjacent paper guide 152. The lower portion of the front major surface of the leading envelope is maintained in contact with the envelope feed rollers 146 by means of a transversely extending envelope press 154 having a gear 156 journaled at opposite ends thereof. An inclined slot 158, having a plurality of lower gear teeth 160, is provided within each side frame 116, 118 for receiving the gears 156 of the envelope press 154 in meshed engagement therewith. In this manner, the envelope press 154 is automatically displaced along a downward inclined path to maintain the lower, front major face of the leading envelope 148 in contact with the envelope feed roller 146. The supply of envelopes 148 may conveniently be renewed by simply displacing the envelope press 154 upwardly along the incline of the slot 158. Upon release of the envelope press 154, the meshed engagement of the gears 156 with the gear teeth 160 causes the envelope press 154 to be displaced downwardly against the envelopes 148 to insure sufficient contact with the envelope feed roller 146.

A pair of L-shaped mounting brackets 162 are each movably secured underlying the forward portion of the paper sheet feeding apparatus 100 underlying the envelope feed assembly 142 and overlying the platen 104. The mounting brackets 162 each include a horizontal leg 163 and a downwardly depending leg 164 terminating at a U-shaped opening 166 adapted to capture the longitudinal ends of the shaft 106 which support the platen 104. Each mounting bracket 162 is movably attached to one of the side frames 116, 118 by means of a dovetail assembly 168 which engages the horizontal leg 163, and which permits their sliding movement relative to the side frames 116, 118. In this manner, the mounting brackets 162 may be adjusted to vary the distance between their respective U-shaped openings 166 to accommodate platens 104 of varying lengths. In this regard, the mounting brackets 162 are constructed and arranged to provide an adjustment factor of approximately 1½ inches. Once the U-shaped openings 166 have captured the longitudinal ends of the shaft 106 supporting the platen 104, a set screw 170 (see FIG. 2) is tightened to prevent sliding movement of the mounting bracket 162 via the dovetail assembly 168.

Figure 2:
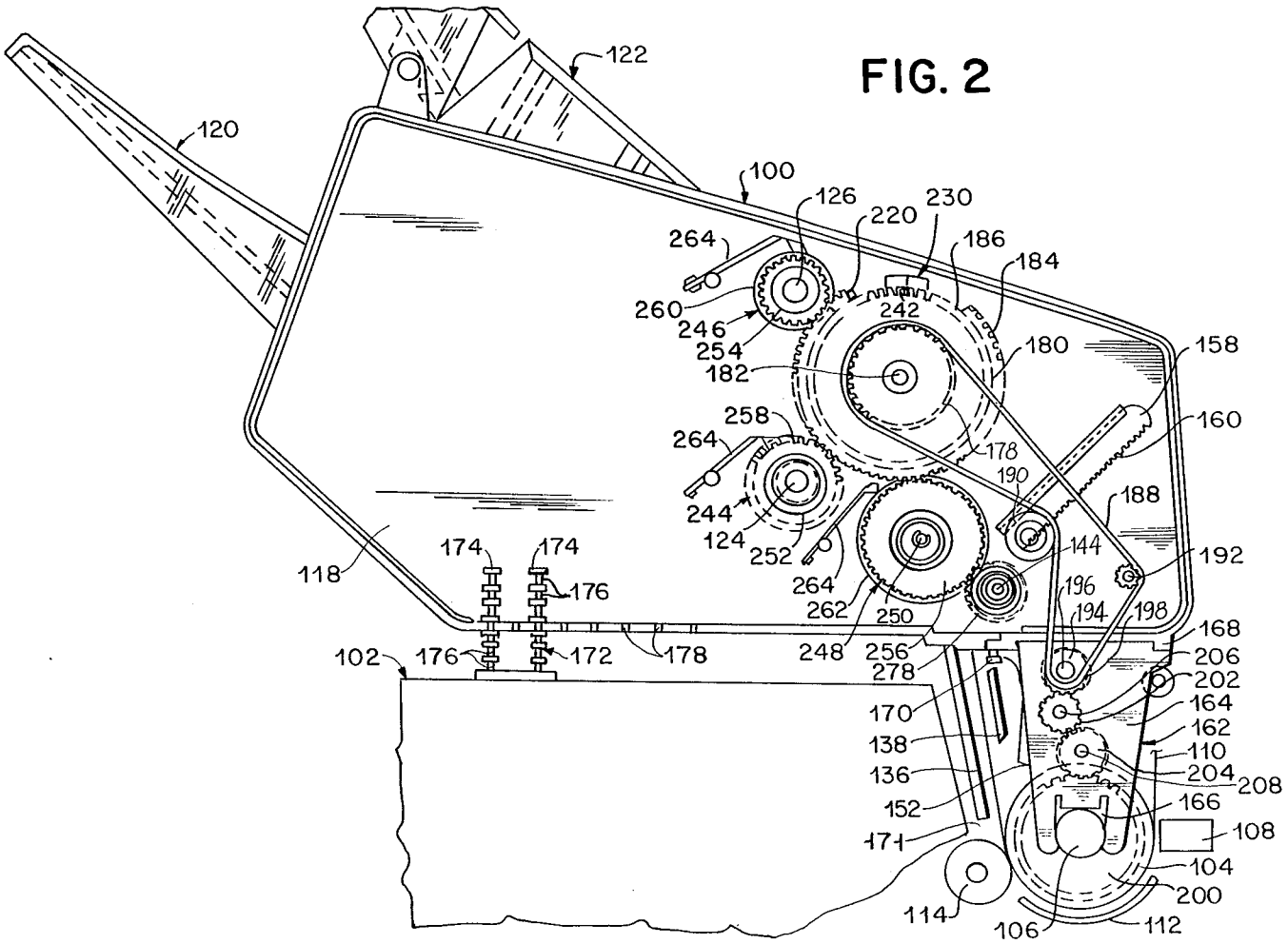
FIG. 2 is a side elevational view showing the printer platen mechanically coupled to a plurality of driven gears by means of a transmission which includes a drive gear selectively coupled to a selector gear by a drive arm.

Referring to FIG. 2, the paper sheet feeding apparatus 100 is mounted overlying the printing device 102 with the depending legs 164 of the mounting brackets 162 extending into a cavity 171 of the printing device for engaging the shaft 106 of the platen 104. A pair of support members 172 are attached to the side frames 116, 118 to support the paper sheet feeding apparatus 100 over the upper surface of the printing device 102 in a substantially horizontal position. The support members 172 are constructed of a pair of spaced-apart resilient legs 174 having a plurality of grooves 176 extending therealong. The lower edge of each side frame 116, 118 is provided with corresponding spaced-apart grooves 178 for capturing the legs 174 of the support members 172 via the grooves 176. In this manner, the support members 172 may be moved forwardly and reawardly along the side frames 116, 118, as well as upwardly and downwardly to achieve the proper level support of the paper sheet feeding apparatus 100 overlying the printing device 102.

Referring now to FIGS. 2 and 3, a transmission, constructed to include a drive gear 178 integrally combined with a coupling gear 180 of greater diameter, is journaled to the side frame 118 about a shaft 182 by means of an axial extension 181. A selector gear 184 of greater diameter than the coupling gear 180, and having a circumferential notched segment 186, is journaled to the shaft 182 about the extension 181 between the integrally formed drive and coupling gears 178, 180 and side frame 118. A flat blade-like spring 187 is provided between the selector gear 184 and the extension 181 of the combined drive and coupling gears 178, 180. From the foregoing construction, it is to be understood that drive gear 178 and coupling gear 180 may be commonly rotated about shaft 182 independent of rotation of the selector gear 184. However, totally free rotation is prevented due to the action of the spring 187 which, in effect, provides a slight coupling force between the selector gear 184 and the combined drive and coupling gears 178, 180.

Clockwise and counterclockwise driving motion of the drive gear 178 is achieved by a drive belt 188 arranged in engagement therewith and extending over a tensioning pulley 190, a spur gear 192 and a drive belt coupling gear 194 journaled to a shaft 196 on the mounting bracket 162. A spur gear 198, secured to the shaft 196, is coupled to a platen gear 200 by means of interposed spur gears 202, 204 which are journaled to respective shafts 206, 208 extending from the mounting bracket 162. As a result of this construction, rotation of the platen 104, in either a clockwise or counterclockwise direction, causes rotation of the drive gear 178 and coupling gear 180 in an opposite direction by means of the effective coupling of the drive belt 188 to the platen gear 200. The drive belt coupling gear 194 and spur gears 198, 202, 204 may be secured at different locations along their respective shafts 196, 206, 208 in order to accommodate the spacial adjustment of the mounting bracket 162 by means of the dovetail assembly 168 to accommodate platens 104 of different size, as previously described.

Figure 6:
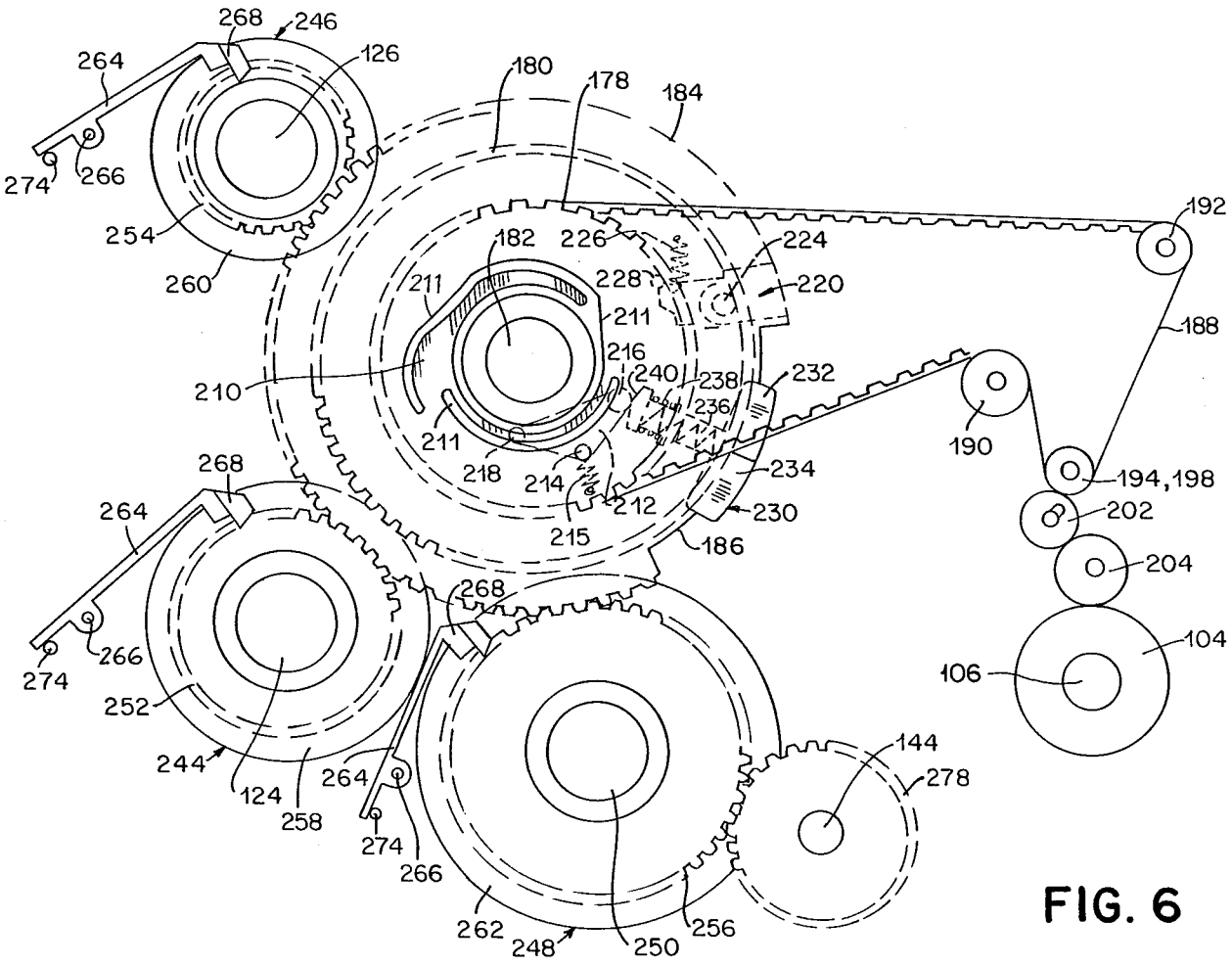
FIGS. 6–9 are side elevational views of the assembly as shown in FIG. 2 in various sequential operating positions for selecting a desired paper or envelope tray, the drive gear being illustrated in transparent form to show the construction and arrangement of an internal cam and cam follower arrangement for effecting the selective coupling of the selector gear with the drive gear by means of the drive arm.

As shown in FIGS. 3 and 6, the inner surface of the selector gear 184 is provided with a profiled cam groove 210 surrounding shaft 182. A triangular-shaped cam plate 212 is pivoted to the side frame 118 opposing the cam groove 210 about a pivot point 214 and biased counterclockwise thereabout by means of a spring 215. The cam plate 212 is provided with a circular cam follower 216 to be received within the cam groove 210 and a shorter projection 218 not engaged within the cam groove. A wedge-shaped selector arm 220 having a camming surface 222 (see FIG. 4) is pivoted at the peripheral edge of the selector gear 184 about pivot point 224. The selector arm 220 is biased in a clockwise direction, as viewed in FIG. 6, by means of spring 226. Clockwise rotation of the selector arm 220 is restricted by a stop member 228 extending outwardly from the selector gear 184 and engaging a portion of the selector arm 220. In this manner, the selector arm 220 may be pivoted in a counterclockwise direction against the force of the spring 226, while being prevented from rotation in the clockwise direction by engagement with the stop member 228.

A selector gear locking assembly 230 is attached to the selector gear 184 and having a pair of diverging ramp-like surfaces 232, 234 positioned mid-way along the length of the notched segment 186. The selector gear locking assembly 230 supports a locking drive arm 236 biased in an extended operative position by a spring 238. The locking drive arm 236 is constructed to include a lower rounded end 240 selectively engagable with the cam follower 216 and projection 218 each of the cam plate 212, and a projecting upper end 242 selectively engagable with the coupling gear 180. In this manner, the projecting upper end 242 of the locking drive arm 236 is normally biased by spring 238 into engagement with the coupling gear 180, thereby permitting common rotation of the selector gear 184 with the combined drive and coupling gears 178, 180. On the other hand, engagement of the lower rounded end 240 of the locking drive arm 236 with either the cam follower 216 or projection 218 each of the cam plate 212, causes disengagement of the projecting upper end 242 from the coupling gear 180, thereby decoupling the selector gear 184 from the combined drive and coupling gears 178, 180.

Mounted outside the side frame 118 onto the ends of the paper shafts 124, 126 are respective driven gear assemblies 244, 246. A similar driven gear assembly 248 is journaled to the side frame 118 about a shaft 250 arranged adjacent envelope paper shaft 144. The driven gear assemblies 244, 246, 248 are of substantially similar construction, with the primary exception of their size, as exemplified by the driven gear assembly 246 shown in FIG. 4. The driven gear assemblies 244, 246 and spur gear 278 attached to paper shaft 144 include an internal one-way clutch, that is, one which permits coupled rotation of the paper shafts 124, 126, 144 by means of rotation of their respective driven gear assembly in one direction only. However, the paper shafts 124, 126, 144 are free, themselves, to be rotated in either a clockwise or counterclockwise direction. Each of the driven gear assemblies 244, 246, 248 are adapted for lateral sliding movement along their respective shafts 124, 126, 250 between engaged and disengaged positions relative to the selector gear 184. The driven gear assemblies 244, 246, 248 each are constructed to include a respective driven gear 252, 254, 256 and an axially displaced circumscribing camming flange 258, 260, 262. The space provided between the driven gears 252, 254, 256 and their respective camming flanges 258, 260, 262 is sufficient to receive, in non-engagement, the peripheral edge of the selector gear 184, as shown in FIG. 4.

Positioning arms 264 are pivoted to the side frame 118 about pivot points 266 adjacent each of the driven gear assemblies 244, 246, 248. Each positioning arm 264 is provided with a positioning head 268, including a projection 270 engaging a respective driven gear 252, 254, 256 and two spaced-apart V-shaped notches 272 alternately engaging a respective camming flange 258, 260, 262. The positioning heads 268 are biased into engagement with the driven gear assemblies 244, 246, 248 by means of bias pins 274 secured to the side frame 118 adjacent the pivot points 266. Each projection 270 on a positioning arm 264, by engaging one of the driven gears 252, 254, 256, prevents their inadvertent rotation while maintaining their teeth in alignment with those of the selector gear 184. On the other hand, the V-shaped notches 272 of the positioning arm 264 prevents inadvertent sliding lateral movement of the driven gear assemblies 244, 246, 248 along the direction indicated by the double arrow along shaft 126.

In accordance with one embodiment of the present invention, as shown in FIG. 5, the teeth of the selector gear 184 and driven gears 252, 254, 256 can be provided with opposing beveled surfaces 276 which will facilitate their meshing in the event of misalignment. In this manner, as the driven gear 254 is slid laterally to the right, contacting of the beveled surfaces 276 will cause slight rotation of the driven gear to achieve proper alignment whereby the teeth of the selector gear 184 may be meshed with those of the driven gear. This alignment is further enhanced by providing the first, second, fourth, fifth and sixth teeth of the selector gear 184, adjacent the notched segment 186, to be shorter than the third tooth, which is of similar length to the remaining teeth of the selector gear. Thus, it is initially only required that the third tooth of the selector gear 184 be aligned with the teeth of the coupling gear 180. The engaged and disengaged positions of the driven gear assemblies 244, 246, 248 are maintained by their respective camming flanges 258, 260, 262 alternately being engaged by one of the two spaced-apart notches 272 of the positioning arms 264.

As a result of dimensional and space requirements, the driven gear assembly 248 for feeding envelopes 148 is coupled to the envelope paper shaft 144, which supports the envelope feed roller 146, by means of the spur gear 278. The spur gear 278 is attached to the envelope paper shaft 144 and has its teeth in full meshing engagement with the teeth of the driven gear 256 at all times. That is, the teeth of the driven gear 256 are in sliding lateral meshed engagement with the teeth of the spur gear 278. As such, rotation of the driven gear 256 by the selector gear 184 will cause rotation of the spur gear 278 and ultimately the envelope feed rollers 146 by means of the envelope paper shaft 144.

The operation of the paper sheet feeding apparatus 100, in accordance with the present invention, will now be described. As shown in FIG. 6, the selector gear 184 is positioned in a neutral or home position with the selector gear locking assembly 230 at approximately four o'clock. In the neutral or home position, the rounded lower end 240 of the selector gear locking assembly 230 is engaged by the cam follower 216 of the cam plate 212, which cam follower is now riding along the outer sidewall 211 of the cam groove 210. As a result of this engagement, the projecting upper end 242 of the locking drive arm 236 is urged radially outward and is disengaged from the teeth of the coupling gear 180, thereby permitting independent clockwise rotation of the drive and coupling gears 178, 180, while the selector gear 184 remains stationary. This clockwise rotation of the combined drive and coupling gears 178, 180 corresponds to rotation of the platen 104 in a paper feeding direction, i.e., counterclockwise. The select either the lower paper tray 120, upper paper tray 122 or envelope feed assembly 142, the printer platen 104 is rotated in a reverse paper feeding direction, i.e., clockwise, to thereby cause counterclockwise rotation of the drive and coupling gears 178, 180 by means of the drive belt 188. As the coupling gear 180 is rotated in a counterclockwise direction, the locking drive arm 236 is disengaged from the cam follower 216 of the cam plate 212, which cam follower is outside the cam groove 210, to cause the projecting upper member 242 of the locking drive arm to engage the teeth of the coupling gear 180. As the coupling gear 180 is rotated in a counterclockwise direction, the slight coupling force with the selector gear 184 provided by spring 187 and the tendency of the lower rounded end 240 of the locking drive arm 236 to disengage from the cam follower 216 under the force of spring 238, this action facilities the coupling and engagement of the projecting upper member 242 with the teeth of the coupling gear. The projecting upper member 242 of the locking drive arm 236 thereby provides direct coupling of the selector gear 184 with the drive and coupling gears 178, 180 for common rotation therewith.

Figure 7:
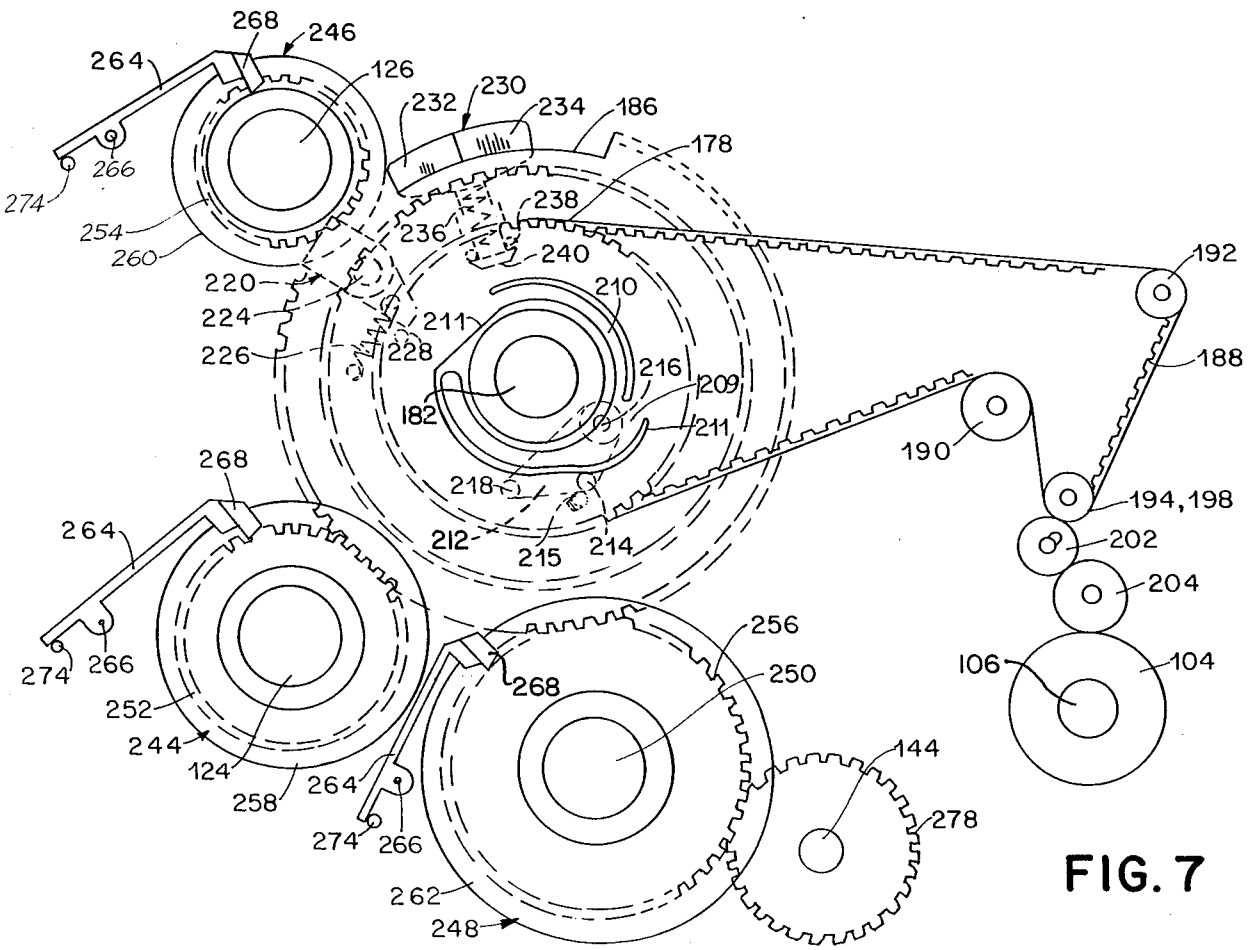

The continued rotation of the platen 104 in the reverse paper feeding direction causes continued counterclockwise rotation of the selector gear 184 to the position shown in FIG. 7 for selecting the upper paper tray 122. As shown in FIG. 4, the driven gear assembly 246 is arranged such that the teeth of the selector gear 184 are aligned with the axial space between the driven gear 254 and camming flange 260. As the selector gear 184 is further rotated in a counterclockwise direction, the camming surface 222 of the selector arm 220 engages the inner surface of the camming flange 260 to laterally slide the driven gear assembly 246 along paper shaft 126 until the driven gear 254 engages the selector gear and the camming flange is engaged by the second of the two spaced-apart V-shaped notches 272. This arrangement is shown in FIG. 7 with the selector arm 220 located just to the left of the driven gear assembly 246 and the selector gear locking assembly 230 just to the right. It is also to be noted that the cam follower 216 of the cam plate 212 has been captured within the cam groove 210 by the opening 209 provided in the outer sidewall 211 and has been advanced therealong by the counterclockwise rotation of the selector gear 184.

Having selected the upper paper tray 122, rotation of the platen 104 is now continued, but in the paper feeding direction, i.e., counterclockwise, as viewed in FIG. 7. The paper feed rollers 130 being driven by the internal one-way clutch in a paper feeding direction along with paper shaft 126, causes a sheet of paper 110 to be withdrawn from the upper paper tray 122 and advanced along the paper path to the platen 104. During this period of clockwise rotation of the selector gear 184, the cam follower 216 of the cam plate 212 remains captured within the cam groove 210 as the selector gear locking assembly 230 initially passes the home position for the first time during the clockwise rotation. It is therefore required that the selector gear 184 be rotated clockwise about 400° until the cam follower will both emerge from the cam groove and be once again at the home position on the outer sidewall 211 to disengage the selector gear locking assembly 230 upon engagement with the lower end 240 thereof. That is, the cam follower 216 upon emerging from the cam groove 210 along the sloped section thereof will then ride along the outer sidewall 211 until it engages the selector gear locking assembly 230 in the home position shown in FIG. 6.

During this continued clockwise rotation of the selector gear 184 to the home position, the engaged selector gear locking assembly 230 is brought past the driven gear assembly 246, whereupon the ramp-like surface 234 engages the camming flange 260 to decouple the driven gear 254 from the coupling gear 180 by laterally sliding the driven gear assembly along the paper shaft 126. In addition, the pivotal arrangement of the selector arm 220 will prevent its interference with the driven gear assembly 246 as it is rotated past same during this clockwise rotation of the selector gear 184. As a result, the continued rotation of the platen 104 in a paper feeding direction will not drive the paper feed rollers 130 which are coupled to the disengaged driven gear assembly 246.

Once the sheet of paper 110 have been fully engaged by the platen 104, the driven gear asesmbly 246 disengages in the manner noted above, and before the selector gear locking assembly 230 has finally reached its home position, as shown in FIG. 6, the platen is again rotated in a reverse paper feeding direction, i.e., clockwise direction. This clockwise rotation of the platen 104 causes the sheet of paper 110 to be fed out of engagement with the platen and back along the paper path towards the upper paper tray 120. However, as the driven gear assembly 246 is provided with an internal one-way clutch, this reverse or clockwise rotation of the platen does not produce reverse feeding rotation of the paper feed rollers 130. As a result, the sheet of paper 110 tends to bulge or form a buckle along the paper path, thereby aligning its leading edge with the entrance of the platen 104. The leading edge of the sheet of paper 110 having now been positioned at the entrance of the platen 104, the platen may once again be rotated in a paper feeding direction the appropriate number of feed lines in order to begin printing on the appropriately designated line. As the platen 104 is rotated in the paper feeding direction, the selector gear locking assembly 230 is rotated with the selector gear 184 into its home position so as to decouple the selector gear from the drive and coupling gears 178, 180. The sheet of paper 110 can be continously advanced by the platen 104 until ejected into a storage tray (not shown).

Figure 8:
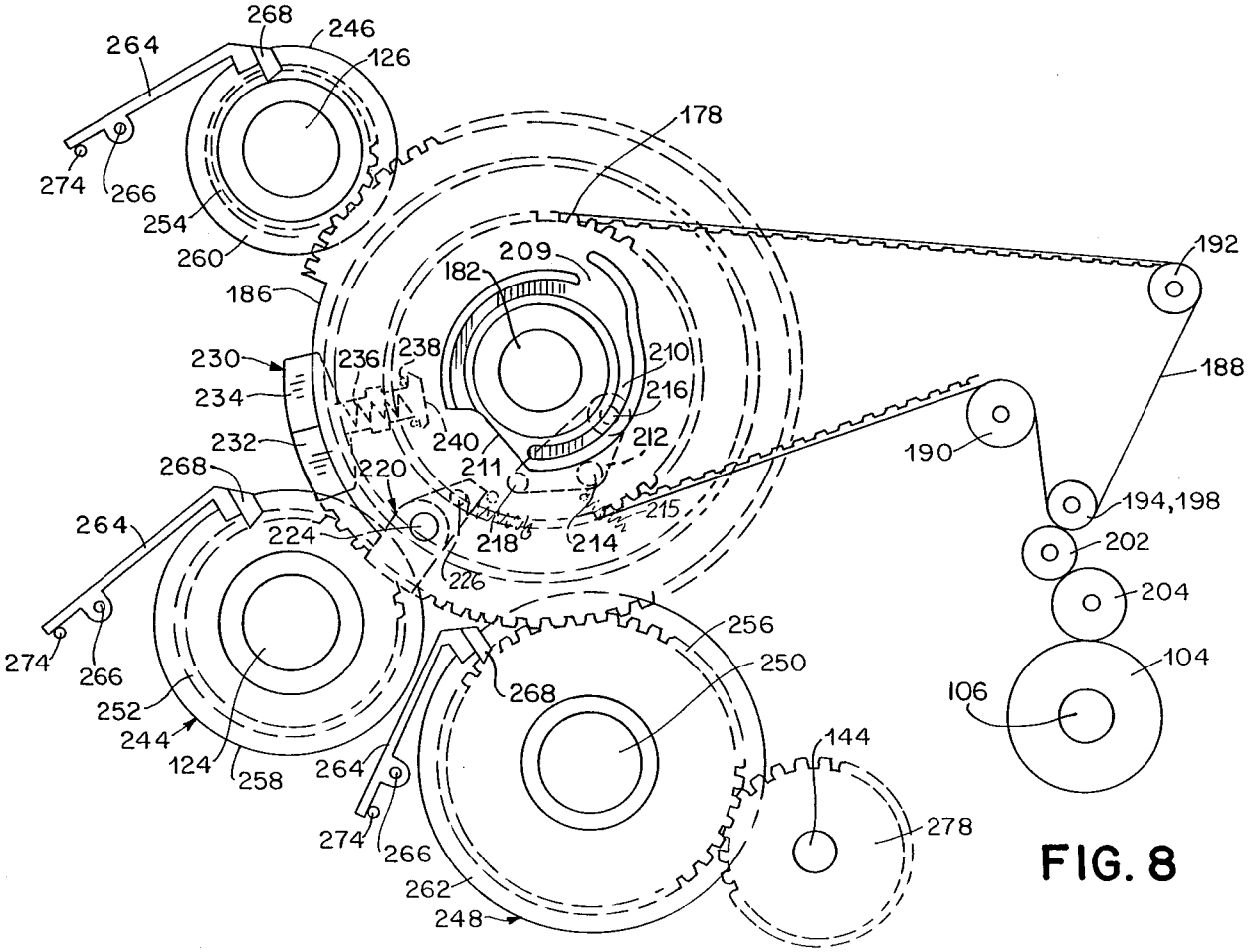

In order to select the lower paper tray 120, the selector gear 184 is rotated in a counterclockwise direction by the reverse paper feeding direction or clockwise rotation of the platen 104 from the home position, as shown in FIG. 6 until the selector gear locking assembly 230 is positioned in advance of the driven gear assembly 244 and the selector arm 220 is positioned slightly past and below, as shown in FIG. 8. As the camming surface 222 of the selector arm 220 engages the camming flange 258 of the driven gear assembly 244, the driven gear 252 is engaged with the selector gear 184 by lateral sliding movement. As further shown, the cam follower 216 of the cam plate 212 remains captured further along within the cam groove 210.

As previously described, the driven gear assembly 246 associated with the upper paper tray 122 has been previously engaged by the selector arm 220, and must now therefore be disengaged before engaging the driven gear assembly 244 associated with the lower paper tray 120. In this regard, the approaching ramp-like surface 232 of the selector gear locking assembly 230, during counterclockwise rotation of the selector gear 184, engages the camming flange 260 of the driven gear assembly 246 to laterally slide the driven gear 254 out of engagement with the selector gear. The feeding of a sheet of paper 110 from the lower paper tray 120 may now continue, as previously described, with regard to the feeding of a sheet of paper from the upper paper tray 122. As the selector gear locking assembly 230 is rotated clockwise past the driven gear assembly 244 to assume its home position, as shown in FIG. 6, its ramp-like surface 234 engages the camming flange 258 to disengage the driven gear 252 from the selector gear 184 thereby preventing further driving of the paper feed rollers 128 by means of paper shaft 124 by the continued counterclockwise rotation of the platen 104. From the foregoing description, it should be apparent that the selection of the lower paper tray 120 is achieved in a similar manner as the selection of the upper paper tray 122.

Figure 9:
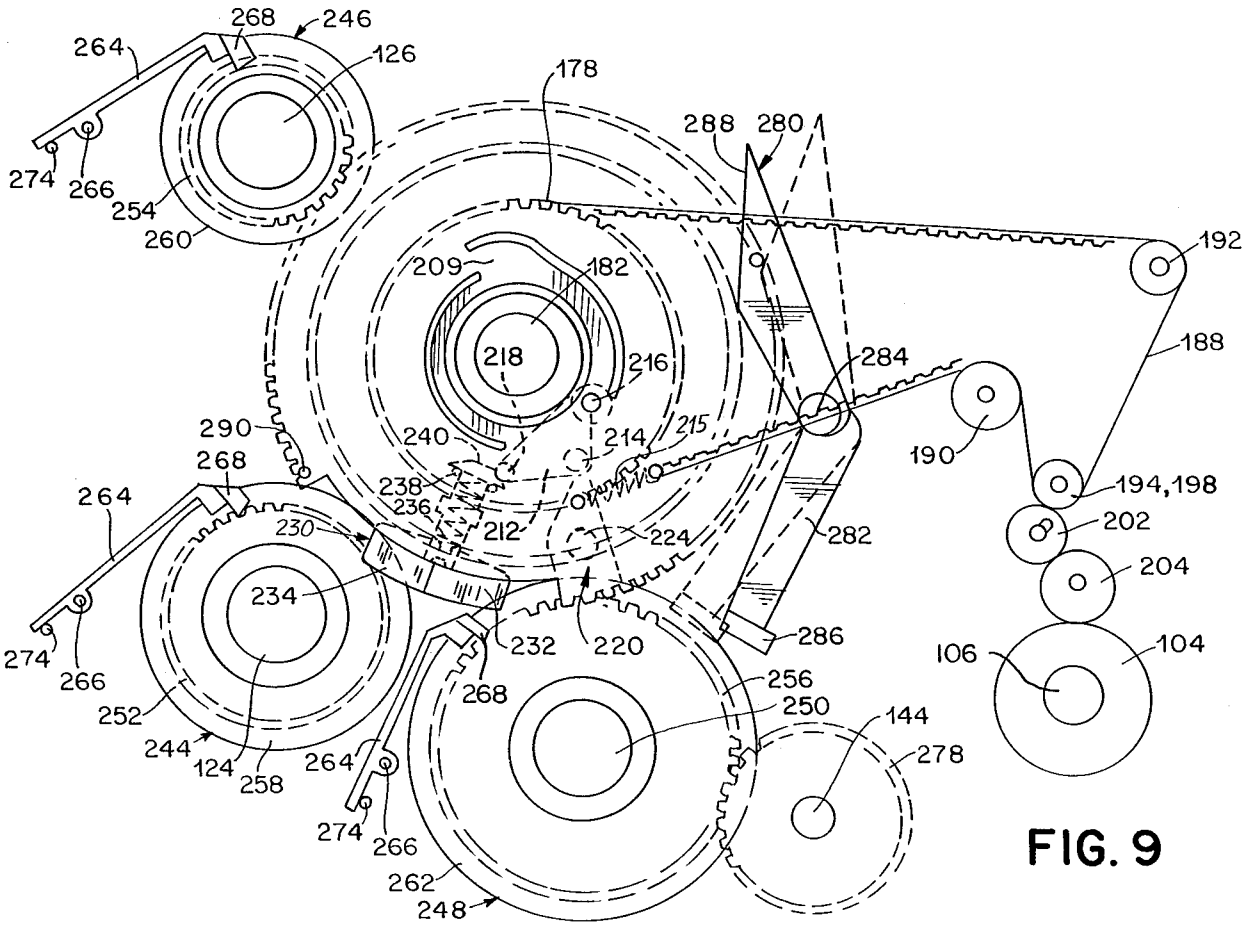

The selection of the envelope feed assembly 142 by means of the driven gear assembly 248 is achieved in precisely the same manner as selecting either the lower paper tray 120 or upper paper tray 122. That is, the selector gear 184 is rotated in a counterclockwise direction by means of the reverse paper feeding direction or clockwise rotation of the platen 104. As shown in FIG. 9, the driven gear assembly 248 associated with the envelope feed assembly 142 is selected by the camming action of the selector arm 220 as its camming surface 222 engages the camming flange 262 to laterally slide the drive gear 256 into engagement with the selector gear 184. The requisite disengagement of the previously engaged driven gear assemblies 244, 246 is achieved by the camming action of the ramp-like surface 232 of the selector gear locking assembly 230 in the manner as previously described. In the event that the selector gear 184 is further rotated in a counterclockwise direction from the position shown in FIG. 9, the selector gear will be decoupled from the combined drive and coupling gears 178, 180. This is achieved by the projection 218, which extends from the cam plate 212, engaging the lower rounded end 240 of the locking drive arm 236. This engagement will bias the projecting upper end 242 radially outward to effect disengagement from the teeth of the coupling gear 180, thereby decoupling the selector gear 184 from the combined driven and coupling gears 178, 180. The projection 218 is positioned in order to engage the selector gear locking assembly 230 as a result of the cam follower 216 of the cam plate 212 being captured at the end of the cam groove 210.

Although it is possible to disengage the driven gear assembly 248 by engagement with the ramp-like surface 234 of the selector gear locking assembly 230 in the manner as previously described with respect to the driven gear assemblies 244, 246, a separate envelope disengaging assembly 280 is provided for this purpose. The envelope disengaging assembly 280 is provided to disengage the driven gear assembly 248 earlier than that which would occur by the selector gear locking assembly 230, in order to accommodate the fact that the envelopes 148 being fed are relatively shorter than the sheets of paper 110 being fed from the lower and upper paper trays 120, 122. The envelope disengaging assembly 280 is constructed of an L-shaped lever 282 centrally pivoted to the side frame 118 about a shaft 284. The lower end of the lever 282 is provided with a wedge-shaped camming surface 286, while the upper end of the lever is provided with an inclined camming surface 288. A pin 290 is provided projecting outwardly from the selector gear 184 adjacent the notched segment 186.

Upon rotation of the selector gear 184 in a clockwise direction, the projecting pin 290 will engage the inclined camming surface 288 to cause pivoting of the L-shaped lever 282 about shaft 284. This pivoting action causes the wedge-shaped camming surface 286 to engage the camming flange 262 of the driven gear asesmbly 248 so as to laterally slide the driven gear 256 out of engagement with the selector gear 184 in a similar manner as previously described with respect to the driven gear assemblies 244, 246. The operation of the envelope disengaging assembly 280 is shown in phantom. Thus, it is not required for the selector gear locking assembly 230 to be rotated past the driven gear assembly 248 to achieve the disengaging of the envelope feed assembly 142.

In accordance with one embodiment of the present invention, the paper sheet feeding apparatus 100 is retrofitted onto a Diablo 3000 printer. The paper sheet feeding apparatus 100 is first initialized by rotation of the platen 104 in a counterclockwise direction sixty-two or more line feeds in order to reset the driven gear assemblies 244, 246, 248 by engagement with the ramp-like surface 234 of the selector gear locking assembly 230. Selection of the lower paper tray 120 is achieved by rotation of the platen 104 in a clockwise direction twenty-two line feeds followed by rotation of the platen in a counterclockwise direction eighteen line feeds, thereby advancing a sheet of paper 110 to the platen. Clockwise rotation of the platen 104 four line feeds aligns the leading edge of the paper 110 with the entrance to the platen and rotation of the platen in a counterclockwise direction nine line feeds positions the paper at the first print line. The selection of the upper paper tray 122 is achieved by rotation of the platen 104 in a clockwise direction thirteen line feeds followed by rotation of the platen in the same manner for selecting the lower paper tray 120. Envelopes 148 are selected by rotation of the platen 104 in a clockwise direction twenty-eight line feeds followed by rotation of the platen in a counterclockwise rotation twenty-three line feeds, thereby advancing an envelope to the first line of print. It is noted that when feeding envelopes 148, the buckling sequence described with respect to sheets of paper 110 is not performed due to the additional thickness of the envelope. Once printing is complete, rotation of the platen 104 in a clockwise direction is again required to select the next sheet of paper 110.

Although the invention herein has been described with reference to particular embodiments, it is to be understood that these embodiments are merely illustrative of the principles and application of the present invention. It is therefore to be understood that numerous modifications may be made in the illustrative embodiments and that other arrangements may be devised without departing from the spirit and scope of the present invention as defined by the appended claims.

What is claimed is:

1. A paper feeding apparatus for a printing device, said printing device including printing means for printing on a sheet of paper, and paper advancing means for advancing a sheet of paper being supplied thereto along a paper path upon rotation of said paper advancing means in a paper advancing direction, said paper feeding apparatus comprising first paper storing means for storing a plurality of individual sheets of paper, first paper feeding means for feeding individual sheets of paper from said first paper storing means upon rotation of said first paper feeding means in a paper feeding direction, first driven gear means slidable between an engaged position with said first paper feeding means to cause the rotation thereof in said paper feeding direction and a disengaged position with said first paper feeding means to interrupt the operation thereof, second paper storing means for storing a plurality of individual sheets of paper, second paper feeding means for feeding individual sheets of paper from said second paper storing means upon rotation of said second paper feeding means in a paper feeding direction, second driven gear means slidable between an engaged position with said second paper feeding means to cause the rotation thereof in said paper feeding direction and a disengaged position with said second paper feeding means to interrupt the operation thereof, and transmission means for selectively coupling said first and second driven gear means to said first and second paper feeding means in response to the rotation of said paper advancing means, said transmission means selectively arrangeing said first and second driven gear means in said engaged position upon rotation of said paper advancing means in an opposite direction to said paper advancing direction and selectively arranging said first and second driven gear means in said disengaged position upon continued rotation of said paper advancing means in said opposite direction, whereby individual sheets of paper are alternately fed from said first and second paper storing means upon selective engagement of a corresponding said first and second driven gear means and upon the rotation of said paper advancing means in said paper advancing direction.

2. The apparatus of claim 1 wherein said transmission means includes first and second gears separately rotatable about a common axis, locking means for coupling said first and second gears together for common rotation about said axis, and selecting means for operatively engaging said first and second driven gear means to couple a corresponding said first and second paper feeding means to said paper advancing means in response to the rotation of said paper advancing means in said opposite direction.

3. The apparatus of claim 2 wherein said locking means includes camming means for disengaging said first and second driven gear means to uncouple a corresponding one of said first and second paper feeding means from said paper advancing means, thereby interrupting the operation thereof.

4. The apparatus of claim 3 further including control means for selectively controlling the operation of said locking means in response to the rotation of said second gear by said paper advancing means.

5. The apparatus of claim 4 wherein said control means comprises a cam groove and cam follower, said cam follower engagable with said locking means for decoupling said first and second gears.

6. The apparatus of claim 3 wherein said second gear includes a peripheral notched segment for receiving said camming means.

7. The apparatus of claim 6 wherein said second gear includes a plurality of gear teeth adjacent said notched segment, a number of said gear teeth of said plurality having a length shorter than the remainder of said gear teeth within said plurality.

8. The apparatus of claim 7 wherein at least said number of gear teeth having a length shorter than the remainder of said gear teeth including a beveled surface thereon to facilitate engagement with said first and second driven gear means.

9. The apparatus of claim 2 wherein said first and second driven gear means include a camming flange engaged with said selecting means.

10. A printing device comprising printing means for printing on a sheet of paper, first paper storing means for storing a plurality of individual sheets of paper, first paper feeding means for feeding individual sheets of paper from said first paper storing means upon rotation of said first paper feeding means in a paper feeding direction, first driven gear means slidable between an engaged position with said first paper feeding means to cause the rotation thereof in said paper feeding direction and a disengaged position with said first paper feeding means to interpret the operation thereof, second paper storing means for storing a plurality of individual sheets of paper, second paper feeding means for feeding individual sheets of paper from said second paper storing means upon rotation of said second paper feeding means in a paper feeding direction, second driven gear means slidable between an engaged position with said second paper feeding means to cause the rotation thereof in said paper feeding direction and a disengaged position with said second paper feeding means to interrupt the operation thereof, paper advancing means for advancing a sheet of paper fed from said first and second paper storing means along a paper path upon rotation of said paper advancing means in a paper advancing direction, and transmission means for selectively coupling said first and second driven gear means to said first and second paper feeding means in response to the rotation of said paper advancing means, said transmission means selectively arranging said first and second driven gear means in said engaged position upon rotation of said paper advancing means in an opposite direction to said paper advancing direction and selectively arranging said first and second driven gear means in said disengaged position upon continued rotation of said paper advancing means in said opposite direction, whereby individual sheets of paper are alternately fed from said first and second paper storing means upon selective engagement of a corresponding said first and second driven gear means and upon the rotation of said paper advancing means in said paper advancing direction.

11. The printing device of claim 10 wherein said transmission means includes first and second gears separately rotatable about a common axis, locking means for coupling said first and second gears together for common rotation about said axis, and selecting means for operativley engaging said first and second driven gear means to couple a corresponding said first and second paper feeding means to said paper advancing means in response to the rotation of said paper advancing means in said opposite direction.

12. The printing device of claim 11 wherein said locking means includes camming means for disengaging said first and second driven gear means to uncouple a corresponding one of said first and second paper feeding means from said paper advancing means, thereby interrupting the operation thereof.

13. The printing device of claim 12 further including control means for selectively controlling the operation of said locking means in response to the rotation of said second gear by said paper advancing means.

14. The printing device of claim 13 wherein said control means comprises a cam groove and cam follower, said cam follower engagable with said locking means for decoupling said first and second gears.

15. The printing device of claim 13 wherein said second gear includes a peripheral notched segment for receiving said camming means.

16. The printing device of claim 15 wherein said second gear includes a plurality of gear teeth adjacent said notched segment, a number of said gear teeth of said plurality having length shorter than the remainder of said gear teeth within said plurality.

17. The printing device of claim 16 wherein at least said number of gear teeth having a length shorter than the remainder of said gear teeth including a beveled surface thereon to facilitate engagement with said first and second driven gear means.

18. The printing device of claim 11 wherein said first and second driven gear means include a camming flange engaged with said selecting means.

19. A method for feeding individual sheets of paper to a printing device, said printing device including printing means for printing on a sheet of paper, paper advancing means for advancing a sheet of paper being supplied thereto along a paper path upon rotation of said paper advancing means in a paper advancing direction, first and second paper storing means for storing a plurality of individual sheets of paper, first and second paper feeding means for feeding individual sheets of paper from a corresponding one of said first and second paper storing means, and first and second driven gear means operable between an engaged position with a corresponding one of said first and second paper feeding means to cause the rotation thereof in a paper feeding direction and a disengaged portion to interrupt the operation thereof, said method comprising the steps of arranging one of said first and second driven gear means in said engaged position by rotating said paper advancing means in an opposite direction to said paper advancing direction, arranging the other of said first and second driven gear means in said disengaged position by rotation of said paper advancing means in said opposite direction, said arranging one of said first and second driven gear means in said engaged position and arranging the other of said first and second driven gear means in said disengaged position comprises laterally sliding said first and second driven gear means to and from said engaged and disengaged positions, and feeding individual sheets of paper from one of said first and second paper storing means by rotating the corresponding engaged driven gear means in a paper feeding direction in response to the rotation of said paper advancing means in said paper advancing direction.

20. The method of claim 19 further including the step of aligning the leading edge of said sheet of paper with said paper advancing means by rotating said paper advancing means in said opposite direction while interrupting the operation of the corresponding one of said first and second paper feeding means.

21. The method of claim 19 wherein said aligning further includes forming a bulge in said sheet of paper between the corresponding one of said first and second paper storing means and said paper advancing means.

* * * * *

UNITED STATES PATENT AND TRADEMARK OFFICE

CERTIFICATE OF CORRECTION

PATENT NO. : 4,729,683

DATED : March 8, 1988

INVENTOR(S) : Staniszewski

It is certified that error appears in the above-identified patent and that said Letters Patent is hereby corrected as shown below:

Column 1, line 7, after "trays", --to--.

Column 2, line 64, after "driven", insert --gear--.

Column 4, lines 41-42, "presenet" should read --present--.

Column 7, line 2, "traverse" should read --transverse--;
line 28, before "automatic", insert --having--;
line 32, "test" should read --text--.

Column 11, line 67, delete "The" and insert therefor --To--.

Column 12, line 16, "facilities" should read --facilitates--.

Column 13, line 18, delete "have" and insert therefor --has--.

Column 14, line 29, "drive" should read --driven--;
line 44, "driven" should read --drive--.

Column 16, line 21, "arrangeing" should read --arranging--.

UNITED STATES PATENT AND TRADEMARK OFFICE

CERTIFICATE OF CORRECTION

PATENT NO. : 4,729,683

DATED : March 8, 1988

INVENTOR(S) : Staniszewski

It is certified that error appears in the above-identified patent and that said Letters Patent is hereby corrected as shown below:

Column 17, line 52, "operativley" should read --operatively--.

Column 18, line 13, after "having", insert --a--;
line 37, delete "portion" and insert therefor --position--.

Signed and Sealed this

Ninth Day of August, 1988

*Attest:*

*Attesting Officer*

DONALD J. QUIGG

*Commissioner of Patents and Trademarks*